US008261936B2

(12) United States Patent
DuMond et al.

(10) Patent No.: US 8,261,936 B2
(45) Date of Patent: Sep. 11, 2012

(54) DEVICE FOR DISPENSING VIALS USEFUL IN SYSTEM AND METHOD FOR DISPENSING PRESCRIPTIONS

(75) Inventors: Jody DuMond, Cary, NC (US); Charles H. Guthrie, Raleigh, NC (US); Joseph C. Moran, Jr., Durham, NC (US); Demetris P. Young, Durham, NC (US); George Raymond Abrams, Jr., Cary, NC (US)

(73) Assignee: Parata Systems, LLC, Durham, NC (US)

( * ) Notice: Subject to any disclaimer, the term of this patent is extended or adjusted under 35 U.S.C. 154(b) by 1180 days.

(21) Appl. No.: 11/599,526

(22) Filed: Nov. 14, 2006

(65) Prior Publication Data

US 2008/0110921 A1 May 15, 2008

(51) Int. Cl.
*G07F 11/00* (2006.01)

(52) U.S. Cl. ..... 221/6; 221/217; 221/200; 221/254; 221/236; 221/253; 221/7; 221/211; 221/252; 221/261; 221/13; 198/444; 198/459.2; 198/443; 198/453; 198/399; 198/397; 198/408; 414/414; 414/795.4

(58) Field of Classification Search ..... 221/6, 217, 221/200, 202, 254, 204, 236, 253, 7, 211, 221/252, 261, 13; 414/288, 414, 795.4; 198/444, 198/459.2, 443, 453, 399, 397, 408
See application file for complete search history.

(56) References Cited

U.S. PATENT DOCUMENTS

| | | | |
|---|---|---|---|
| 1,316,996 | A | 9/1919 | Applegate |
| 1,456,690 | A | 5/1923 | Goldberger |
| 1,760,859 | A | 5/1930 | Lach |
| 1,910,327 | A | 5/1933 | Gaynor |
| 2,033,358 | A | 3/1936 | Risser |
| 2,338,852 | A | 1/1944 | Hohl et al. |
| 2,665,775 | A | 1/1954 | Smith |
| 2,708,996 | A | 5/1955 | Skillman |
| 2,749,003 | A | 6/1956 | Zimmermann |
| 2,865,532 | A | 12/1958 | Smith |
| 3,023,851 | A | 3/1962 | Stiller |

(Continued)

FOREIGN PATENT DOCUMENTS

| | | |
|---|---|---|
| CA | 936501 | 11/1973 |

(Continued)

OTHER PUBLICATIONS

International Search Report and Written Opinion for PCT/US2007/015457 dated Dec. 13, 2007.

*Primary Examiner* — Gene O. Crawford
*Assistant Examiner* — Rakesh Kumar
(74) *Attorney, Agent, or Firm* — Myers Bigel Sibley & Sajovec

(57) ABSTRACT

An apparatus for dispensing open-ended objects such as pharmaceutical vials includes: a housing having an internal cavity configured to house open-ended objects, the housing including a guide and a floor; a pick-up unit mounted to the housing, the pick-up unit including an endless member and at least one pick-up member attached to the endless member; and a drive unit. The endless member engages the drive unit and the guide for movement relative thereto. As the drive unit drives the endless member, the at least one pick-up member travels on a pick-up path, at least a portion of which is within the housing.

9 Claims, 14 Drawing Sheets

U.S. PATENT DOCUMENTS

| | | | | | |
|---|---|---|---|---|---|
| 3,144,958 | A | | 8/1964 | Gumpertz | |
| 3,160,793 | A | | 12/1964 | Colburn | |
| 3,179,288 | A | | 4/1965 | Davy | |
| 3,185,851 | A | | 5/1965 | D'Emilio | |
| 3,196,276 | A | | 7/1965 | Naab | |
| 3,206,062 | A | * | 9/1965 | Rappaport | 221/7 |
| 3,310,199 | A | | 3/1967 | Roberts | |
| 3,312,372 | A | | 4/1967 | Cooper, Jr. | |
| 3,338,373 | A | * | 8/1967 | Aidlin et al. | 198/397.05 |
| 3,410,450 | A | | 11/1968 | Fortenberry | |
| 3,417,542 | A | * | 12/1968 | Merrill et al. | 53/167 |
| 3,436,736 | A | | 4/1969 | Platt | |
| 3,440,798 | A | * | 4/1969 | Rackley | 53/312 |
| 3,447,707 | A | * | 6/1969 | Furst | 414/414 |
| 3,556,342 | A | | 1/1971 | Guarr | |
| 3,599,152 | A | | 8/1971 | Williams | |
| 3,618,642 | A | | 11/1971 | Beaulieu | |
| 3,653,176 | A | | 4/1972 | Gess | |
| 3,674,040 | A | | 7/1972 | Howells et al. | |
| 3,730,388 | A | * | 5/1973 | Bender | 221/68 |
| 3,732,544 | A | | 5/1973 | Obland | |
| 3,746,211 | A | * | 7/1973 | Burgess, Jr. | 221/7 |
| 3,771,284 | A | | 11/1973 | Boeckmann et al. | |
| 3,780,907 | A | | 12/1973 | Colburn | |
| 3,815,780 | A | | 6/1974 | Bauer | |
| 3,837,139 | A | | 9/1974 | Roseberg | |
| 3,855,759 | A | | 12/1974 | Pohlenz | |
| 3,885,702 | A | | 5/1975 | Joslin | |
| 3,917,045 | A | | 11/1975 | Williams | |
| 3,975,886 | A | | 8/1976 | Waters | |
| 4,045,276 | A | | 8/1977 | Zodrow | |
| 4,075,820 | A | | 2/1978 | Standley | |
| 4,132,318 | A | | 1/1979 | Wang et al. | |
| 4,173,271 | A | * | 11/1979 | Copp | 194/211 |
| 4,267,942 | A | | 5/1981 | Wick | |
| 4,434,602 | A | | 3/1984 | Culpepper | |
| 4,546,901 | A | | 10/1985 | Buttarazzi | |
| 4,567,714 | A | | 2/1986 | Chasman | |
| 4,573,606 | A | | 3/1986 | Lewis | |
| 4,654,727 | A | | 3/1987 | Blum et al. | |
| 4,655,026 | A | | 4/1987 | Wigoda | |
| 4,664,289 | A | | 5/1987 | Shimizu | |
| 4,674,259 | A | * | 6/1987 | Hills | 53/202 |
| 4,674,651 | A | | 6/1987 | Scidmore | |
| 4,693,057 | A | | 9/1987 | Rittinger | |
| 4,695,954 | A | | 9/1987 | Rose | |
| 4,709,798 | A | | 12/1987 | Herzog | |
| 4,766,542 | A | | 8/1988 | Pilarczyk | |
| 4,767,023 | A | | 8/1988 | Hackmann | |
| 4,805,377 | A | | 2/1989 | Carter | |
| 4,838,406 | A | * | 6/1989 | Levasseur | 194/346 |
| 4,846,619 | A | | 7/1989 | Crabtree et al. | |
| 4,869,392 | A | | 9/1989 | Moulding, Jr. | |
| 4,897,992 | A | * | 2/1990 | Kogiso et al. | 57/281 |
| 4,918,604 | A | | 4/1990 | Baum | |
| 4,971,513 | A | | 11/1990 | Bergerioux | |
| 4,980,292 | A | | 12/1990 | Elbert | |
| 4,984,709 | A | | 1/1991 | Weinstein | |
| 5,018,644 | A | | 5/1991 | Hackmann | |
| 5,047,948 | A | | 9/1991 | Turner | |
| 5,337,919 | A | | 8/1994 | Spaulding et al. | |
| 5,439,093 | A | * | 8/1995 | Drewitz | 198/399 |
| 5,479,762 | A | | 1/1996 | Bliss | |
| 5,571,325 | A | | 11/1996 | Ueyama et al. | |
| 5,632,594 | A | * | 5/1997 | Missing | 414/746.7 |
| 5,860,563 | A | * | 1/1999 | Guerra et al. | 221/172 |
| 6,016,291 | A | | 1/2000 | Joos | |
| 6,039,209 | A | * | 3/2000 | Yuyama et al. | 221/171 |
| 6,085,938 | A | | 7/2000 | Coughlin | |
| 6,102,246 | A | | 8/2000 | Goulet et al. | |
| 6,189,733 | B1 | | 2/2001 | Nemoto et al. | |
| 6,257,393 | B1 | * | 7/2001 | Phelps | 198/397.01 |
| 6,363,652 | B1 | * | 4/2002 | Spinelli | 43/44.99 |
| RE37,829 | E | | 9/2002 | Charhut | |
| 6,478,185 | B2 | * | 11/2002 | Kodama et al. | 221/6 |
| 6,519,913 | B2 | | 2/2003 | Higashizaki et al. | |
| 6,631,826 | B2 | | 10/2003 | Pollard et al. | |
| 6,799,696 | B2 | * | 10/2004 | Okada et al. | 221/200 |
| 7,100,796 | B1 | | 9/2006 | Orr et al. | |
| 7,222,719 | B2 | * | 5/2007 | Shackelford et al. | 198/459.2 |
| 2002/0106305 | A1 | * | 8/2002 | Willenbring et al. | 422/63 |
| 2004/0004085 | A1 | | 1/2004 | Williams et al. | |

FOREIGN PATENT DOCUMENTS

| | | | |
|---|---|---|---|
| DE | 2207396 | A1 | 8/1973 |
| DE | 3605921 | A1 | 8/1987 |
| DE | 3927491 | A1 | 2/1991 |
| EP | 0 453 902 | A1 | 10/1991 |
| EP | 0571980 | A1 | 5/1993 |
| EP | 1 081 663 | A2 | 3/2001 |
| EP | 1 542 175 | A1 | 6/2005 |
| FR | 1436389 | | 7/1966 |
| GB | 517 972 | A | 2/1940 |
| GB | 1168758 | | 10/1969 |
| GB | 1327088 | | 8/1973 |
| GB | 1411951 | | 10/1973 |
| JP | 51-792 | | 1/1976 |
| JP | 52-047400 | | 12/1977 |
| JP | 61-104904 | | 5/1986 |
| JP | 63-208410 | | 8/1988 |
| JP | 64-28102 | | 1/1989 |
| JP | 1-288265 | | 11/1989 |
| JP | 2-28417 | | 1/1990 |
| WO | WO 99/14144 | | 3/1999 |
| WO | WO 02/09557 | A1 | 2/2002 |

* cited by examiner

DEVICE FOR DISPENSING VIALS USEFUL IN SYSTEM AND METHOD FOR DISPENSING PRESCRIPTIONS

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (ie., a lid) on the container after it is filled.

One additional automated system for dispensing pharmaceuticals is described in some detail in U.S. Pat. No. 6,971,541 to Williams et al. (hereinafter Williams '541). This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. For example, with some types of vials, and in particular vials that include structural features for the securing of a cap, the vials have a tendency to "nest" (i.e. the vials tend to stick together, with the closed end of one vial being stuck in the open end of an adjacent vial). Also, the Williams '541 system described above utilizes a carousel-type system with vertical tubes that house vials for dispensing. This system requires that the vials be stacked end-to-end in a specific orientation in the tubes for dispensing; such stacking of vials can be time consuming. As such, improvements to the dispensing of vials may be desirable.

SUMMARY OF THE INVENTION

As a first aspect, embodiments of the present invention are directed to an apparatus for dispensing open-ended objects such as pharmaceutical vials. The apparatus comprises: a housing having an internal cavity configured to house open-ended objects, the housing including a guide and a floor; a pick-up unit mounted to the housing, the pick-up unit including an endless member and at least one pick-up member attached to the endless member; and a drive unit. The endless member engages the drive unit and the guide for movement relative thereto. As the drive unit drives the endless member, the at least one pick-up member travels on a pick-up path, at least a portion of which is within the housing. In this configuration, the apparatus can quickly and efficiently dispense loosely and randomly distributed objects from within the housing.

As a second aspect, embodiments of the present invention are directed to an apparatus for dispensing open-ended objects. The apparatus comprises: a housing having an internal cavity configured to house open-ended objects, the housing including a guide and a floor; a pick-up unit mounted to the housing, the pick-up unit including an endless member and at least one pick-up member attached to the endless member; and a drive unit. The endless member engages the drive unit and the guide for movement relative thereto. As the drive unit drives the endless member, the at least one pick-up member travels on a pick-up path, at least a portion of which is within the housing. The floor slopes at an angle relative to horizontal such that open-ended objects within the cavity are urged to be oriented in a preferred orientation in which an object axis that is generally perpendicular to the open end of the object is generally coincident with the pick-up path.

As a third aspect, embodiments of the present invention are directed to an apparatus for dispensing singulated open-ended objects, the apparatus comprising: a housing having a guide and an internal cavity configured to house open-ended objects, the housing including a dispensing exit; a pick-up unit mounted to the housing, the pick-up unit including an endless member and at least one pick-up member attached to the endless member; a drive unit, wherein the endless member engages the drive unit and the guide for movement relative thereto, and wherein the at least one pick-up member is mounted to the endless member such that, as the drive unit drives the endless member, the at least one pick-up member travels on a pick-up path, at least a portion of which is within the housing; a delivery chute attached to the housing such that an upper end thereof is fed by the dispensing exit; and a capture mechanism associated with the dispensing chute, the capture mechanism movable between a capture position, in which an object cannot pass through the delivery chute, and a passage position, in which an object can pass through the delivery chute. In this configuration, the apparatus can "pre-stage" objects for dispensing, which can render the dispensing operation more predictable and timely.

As a fourth aspect, embodiments of the present invention are directed to a method of dispensing singulated, open-ended pharmaceutical vials. The method comprises the steps of: providing a housing containing a plurality of open-ended pharmaceutical vials, the housing being configured such that the open-ended vials are urged to align along a pick-up path; passing a pick-up member along the pick-up path to engage and capture a container; and continuing to pass the pick-up member and the captured vial through the housing to a dispensing exit.

DETAILED DESCRIPTION OF EMBODIMENTS OF THE INVENTION

Figure 1:
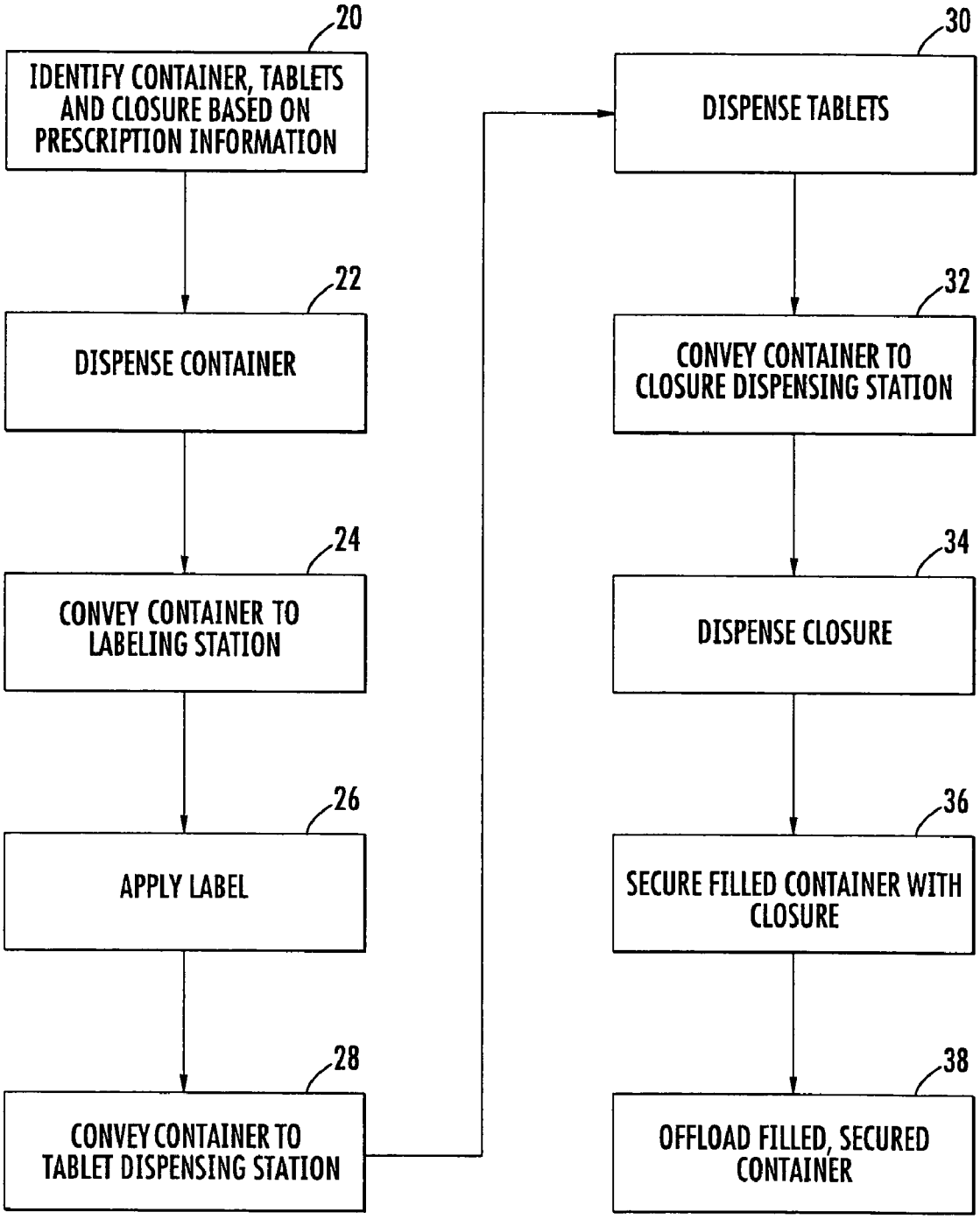
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals, and more specifically to the singulation and dispensing of open-ended objects, such as vials, within such a system (as used herein, the term "vial" is intended to encompass open-ended containers, particularly those that contain pharmaceuticals, that are of generally constant cross-section and those that include a narrowed "neck" section near the open end). An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then travels to a labeling station (Box 24). The labeling station applies a label (Box 26), after which the container travels to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
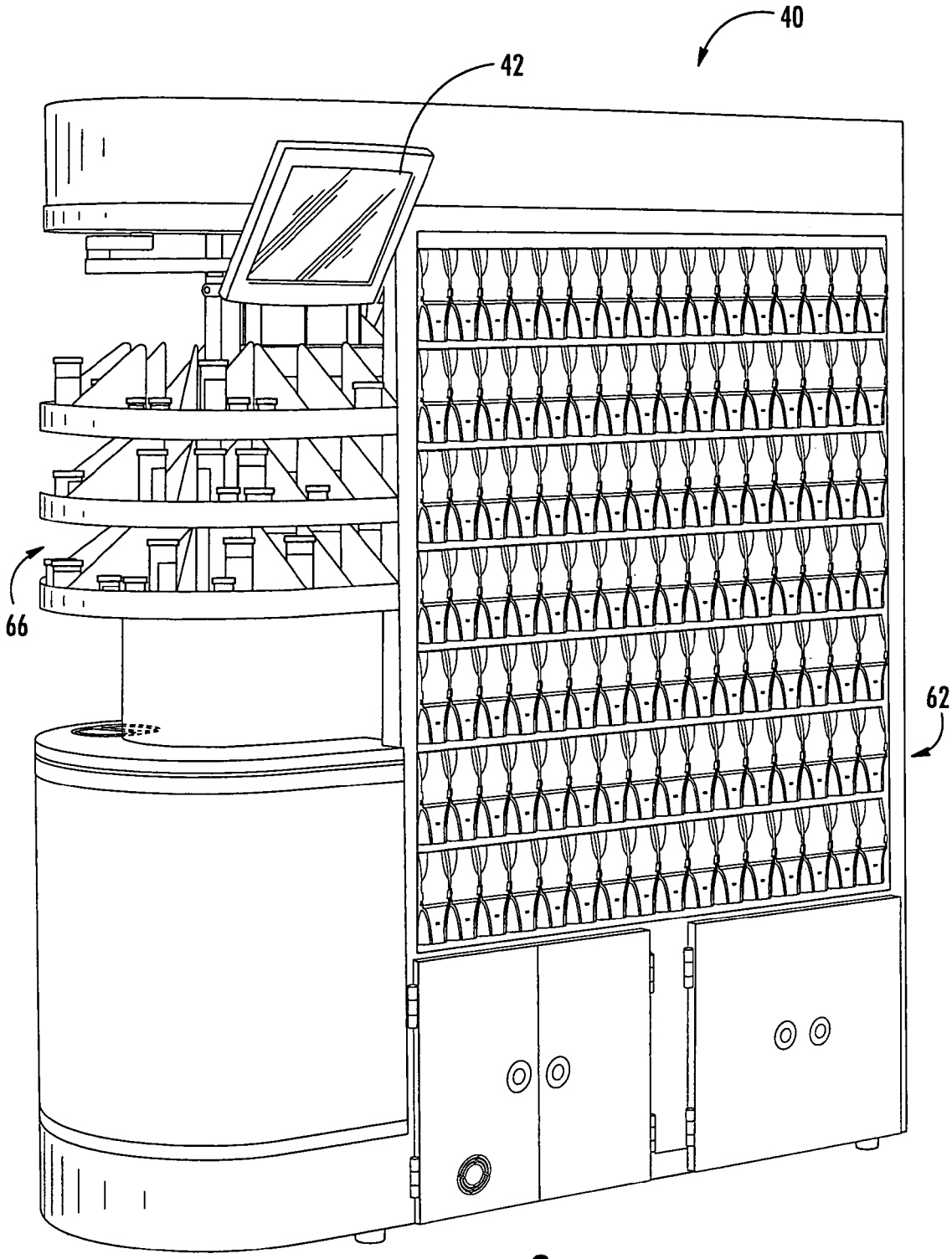
FIG. 2 is a front perspective view of a pharmaceutical tablet dispensing system according to the present invention.
Figure 3:
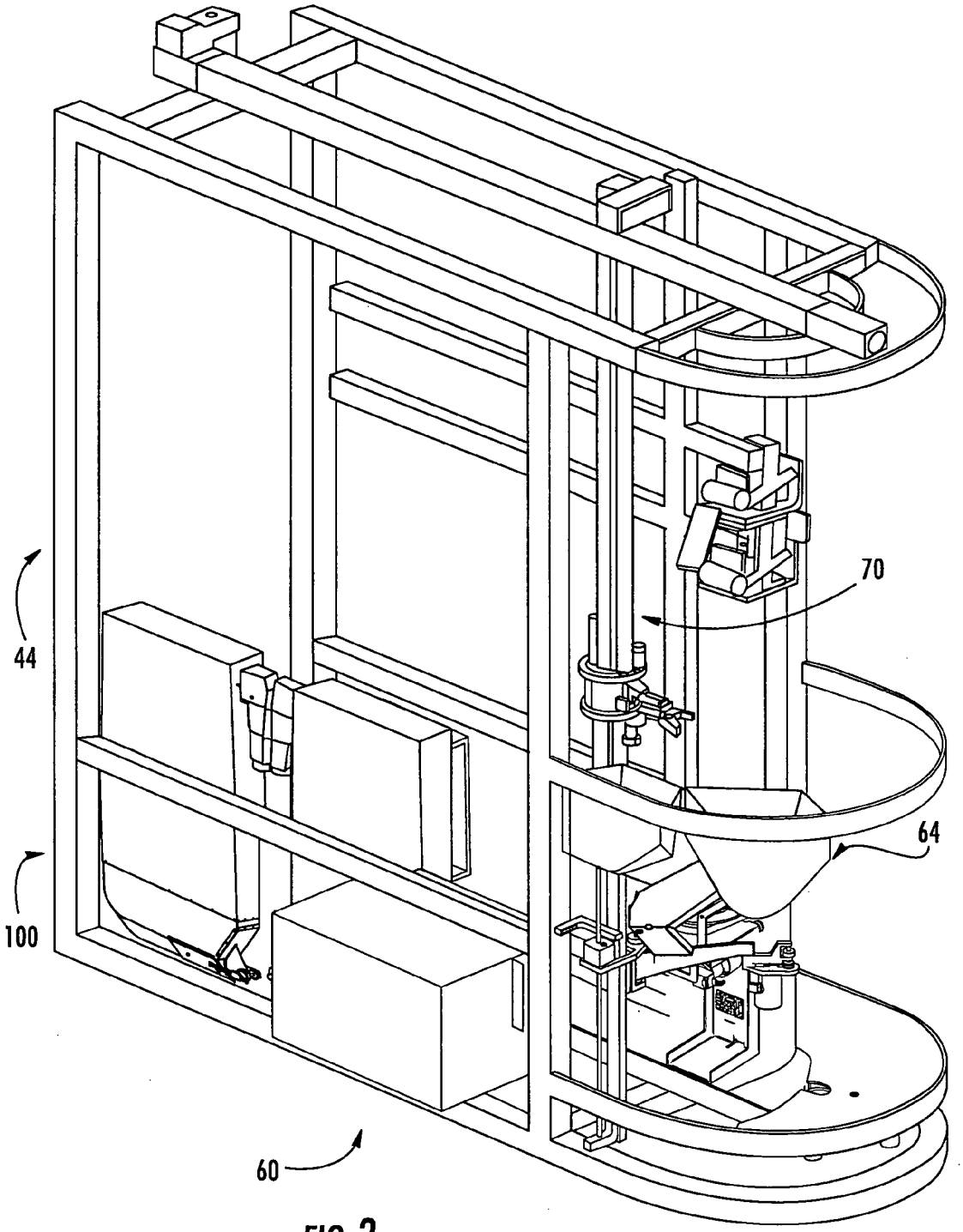
FIG. 3 is a rear cutaway perspective view of the system of FIG. 2 illustrating the support frame, the container dispensing station, the labeling station, the dispensing carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 100, a labeling station 60, a tablet dispensing station 62, a closure station 64, and an offloading station 66. In the illustrated embodiment, containers, tablets and closures are moved between these stations with a dispensing carrier 70; however, in some embodiments multiple carriers may be employed. With the exception of the container dispensing station 100, which is described in detail below, examples of each of the other operative stations and the conveying devices is described in detail in U.S. Pat. No. 6,971,541 to Williams et al., the disclosure of which is hereby incorporated herein in its entirety.

Figure 4:
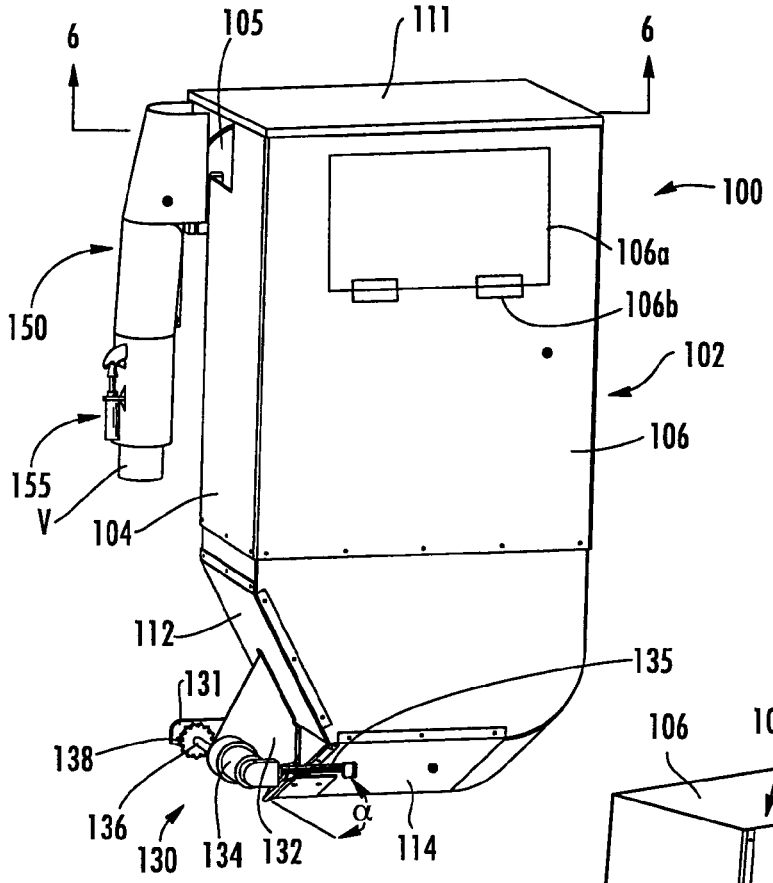
FIG. 4 is a front perspective view of a vial dispenser for use in a pharmaceutical tablet dispensing system such as that shown in FIGS. 2 and 3.
Figure 5:
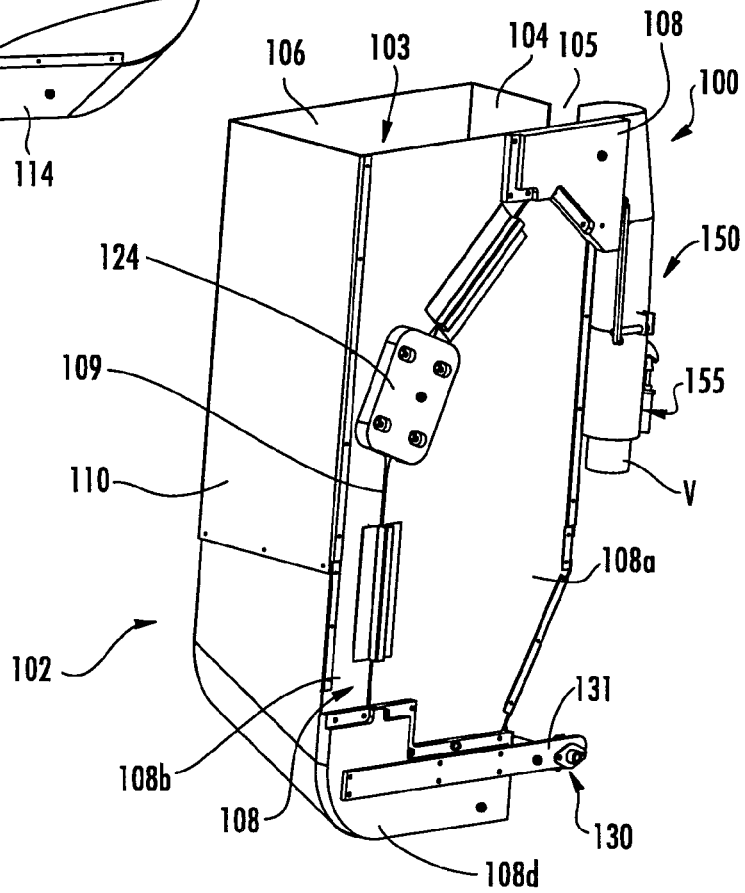
FIG. 5 is a rear perspective view of the vial dispenser of FIG. 4.
Figure 6:
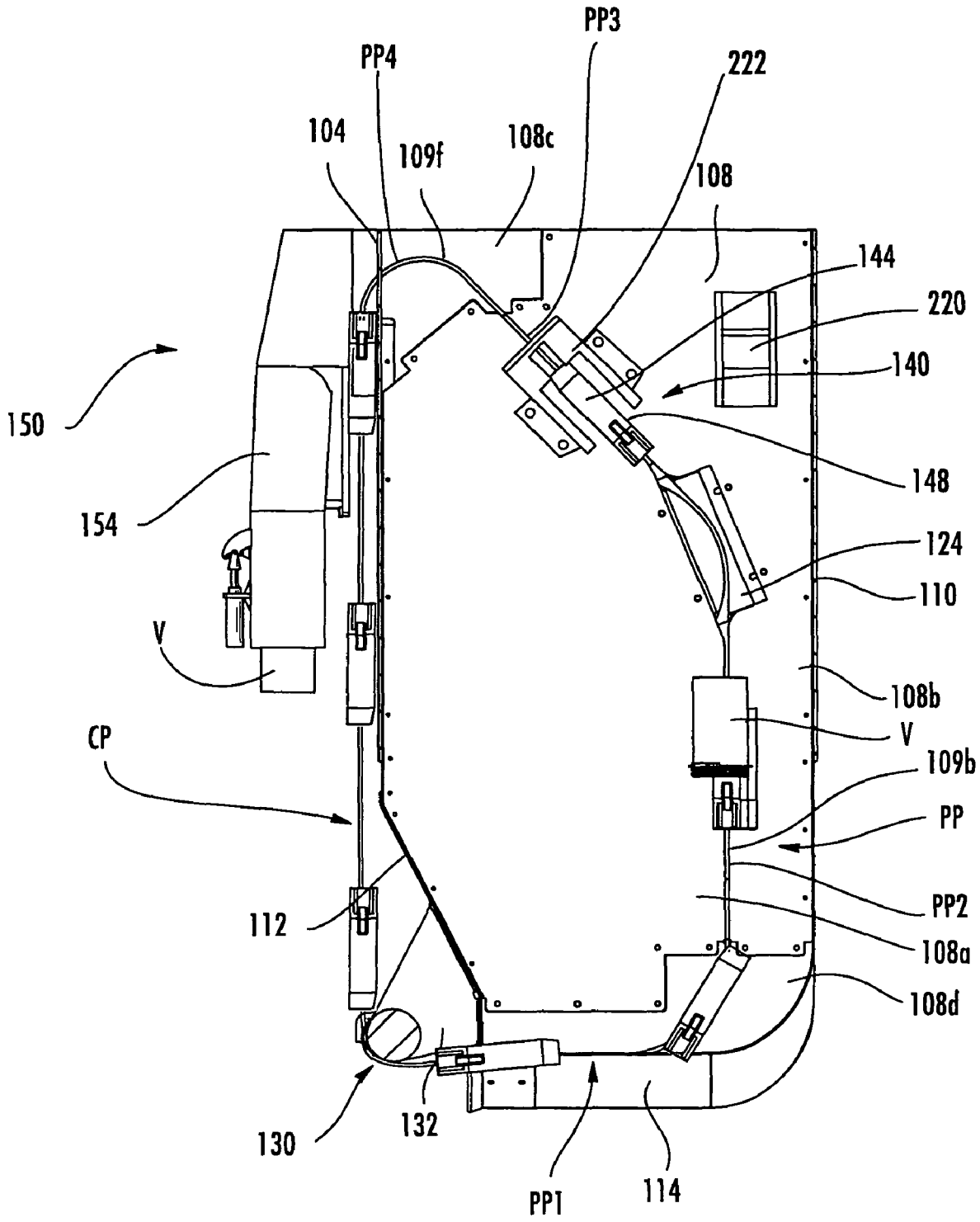
FIG. 6 is a section view of the vial dispenser of FIG. 4 taken along lines 6-6 thereof.

Referring now to FIGS. 4-6, the structure of the container dispensing station 100 is illustrated in some detail therein. The container dispensing station 100 includes a housing 102, a drive unit 130, a vial pick-up unit 140, a delivery chute 150, and a capture mechanism 155. These components are described in greater detail below.

The housing 102 includes a front wall 104, a side wall 106, a chain mounting wall 108, a rear wall 110, a floor 114 and a ceiling 111 that define a cavity 103. As used herein to describe the relative positions of various components, the terms "front," "forward", and derivatives thereof refer to the horizontal direction defined by a vector beginning at the rear wall 110 and extending toward the front wall 104. The terms "rear", "back" and derivatives thereof refer to the direction opposite the forward direction. The terms "outward," "outer," "lateral" and derivatives thereof refer to the direction defined by a vector beginning at a vertical plane parallel to the forward direction that divides the housing 102 in the center and extending toward its periphery; the terms "inner," "inward" and derivatives thereof refer to the direction opposite the outward direction.

The front wall 104 is generally flat and vertically disposed. The front wall 104 includes a finger exit window 105 at its upper edge adjacent the chain mounting wall 108. A front slide panel 112 is attached to the lower end of the front wall 104 and extends downwardly and slightly rearwardly therefrom. A finger entry window 115 (see FIG. 7) is located in the front slide panel 112 adjacent the chain mounting wall 108.

The side wall 106 is generally vertically disposed and extends between the front and rear walls 104, 110. A door 106*a* is attached at its lower edge to the side wall 106 via a hinge 106*b*; the door 106*a* is movable between open and closed positions and allows vials to be loaded into the cavity 103, even when the container dispensing station 100 is operating. In some embodiments, the door 106*a* may be attached to the housing 102 via a different mechanism or at a different location, may cover the open top end of the housing 102, or may be omitted entirely.

Referring now to FIGS. 4 and 6, an angled floor 114 is attached to the lower edge of the side wall 106 and slopes downwardly therefrom at an angle $\alpha$ relative to horizontal to the lower edge of the chain mounting wall 108. In the illustrated embodiment, the angle $\alpha$ is between about 20 and 35 degrees, and in particular between about 25 and 30 degrees, although other dispositions of the floor may also be employed (including a level disposition). At its front edge, the floor 114 meets the lower edge of the front slide panel 112 and underlies the finger entry window 115 (see FIG. 7), and at its rear end portion the floor 114 curves upwardly to merge smoothly with the lower end of the rear wall 110. A wedge-shaped deflector 114*a* is disposed below the finger entry window 115, and a deflector 114*b* is disposed above the finger entry window 115. In this embodiment, the finger entry window 115 defines a space between deflectors 114*a*, 114*b* of about 1.2 inches, which can prevent vials from exiting the housing 102 through the finger entry window 115 (see FIG. 7).

The rear wall 110 is generally planar and vertically disposed. The rear wall 110 spans the rear edges of the side wall 106 and the chain mounting wall 108.

The chain mounting wall 108 (best seen in FIGS. 5 and 6) is generally planar and vertically disposed and is formed of a main panel 108*a*, a rear panel 108*b*, a top panel 108*c*, and a bottom panel 108*d*. The main panel 108*a* is attached to the rear panel 108*b* via a chain track 109 that includes a channel (not shown) and an inwardly-facing slot 109*b*. The bottom panel 108*d*, which is fixed to the lower edge of the main panel 108*a*, includes a generally horizontal channel 109*c* (see FIG. 7A) with an inwardly facing slot 109*d*. The channel 109*c* and slot 109*d* merge smoothly with, respectively, the channel in the chain track 109 and the slot 109*b*. Further, the top panel 108*c* includes an arcuate channel (also not visible) with an inwardly facing slot 109*f* that merge with, respectively, the channel of the chain track 109 and the slot 109*b*. Also, an optional chain tensioner 124 is positioned on the outer surface of the chain mounting wall 108.

Figure 7:
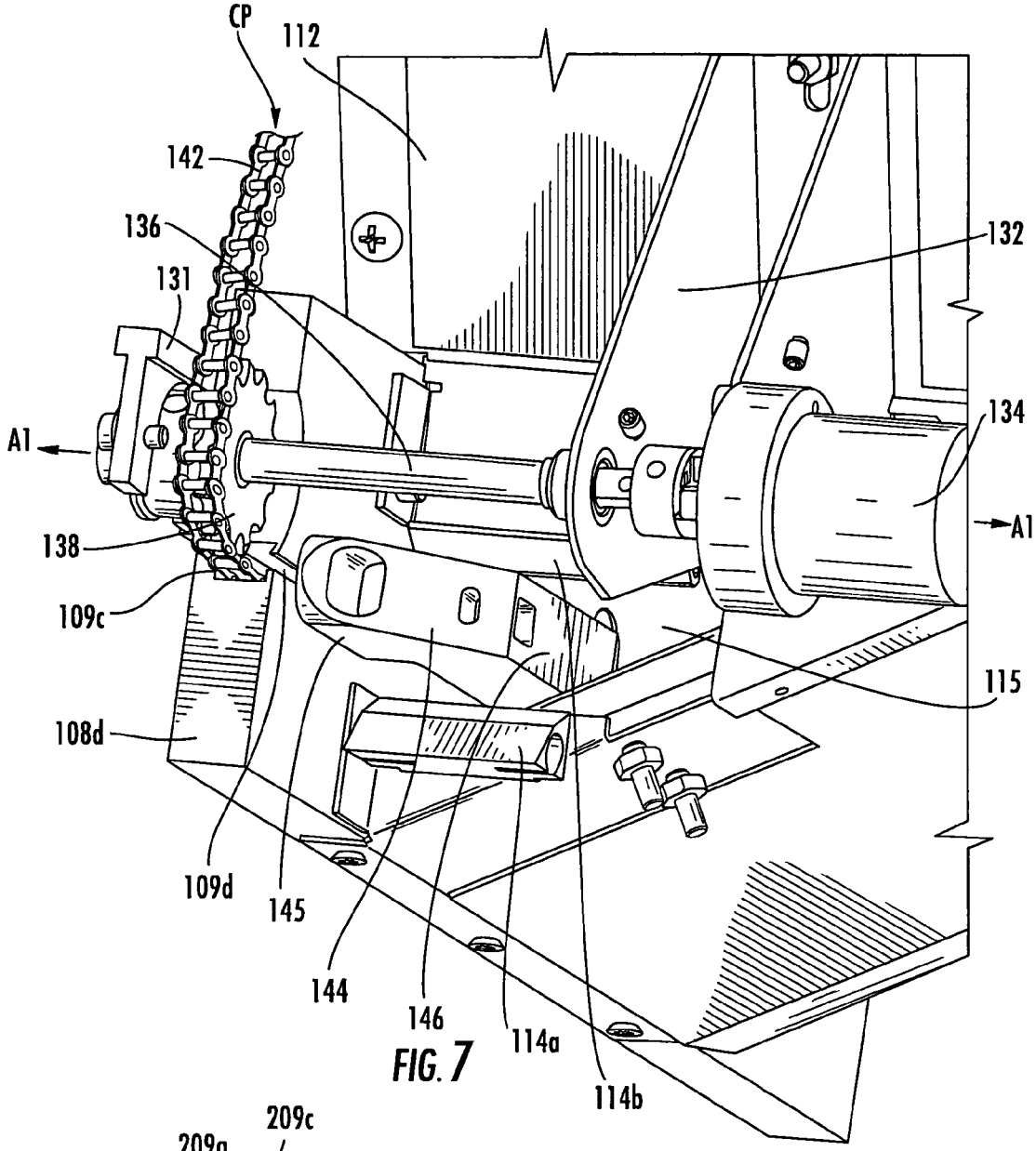
FIG. 7 is an enlarged front, bottom perspective view of the finger entry window of the vial dispenser of FIG. 4.
Figure 7A:
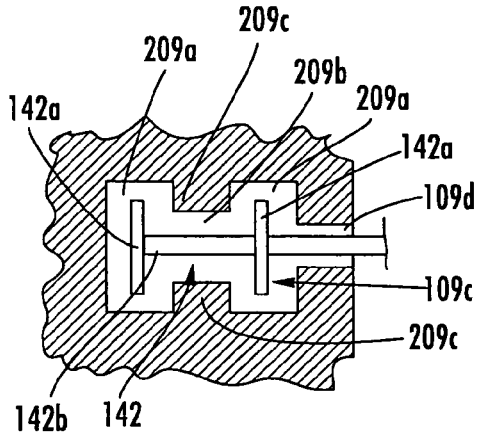
FIG. 7A is an enlarged front section view of the channel and chain seen in FIG. 7.

Referring to FIG. 7A, the channel 109*c* and the other channels of the chain track 109 have a profile that includes two ends 209*a*, one of which is contiguous with the slot 109*d*, and a necked portion 209*b* formed by two projections 209*c* that extend from the walls into the channel. This configuration may be desirable for retaining in position and alignment the links of a chain, such as the chain 142 discussed below, as the projections 209*c* can "nest" between the panels 142*a* of the chain 142 that are connected by pivot pins 142*b* and reduce the instability of the chain as it moves through the channel 109*c*.

Referring now to FIGS. 4 and 7, the drive unit 130 includes a motor mounting arm 131 that is fixed to the bottom panel 108*d* of the chain mounting wall 108 and extends forwardly therefrom, and a motor mounting bracket 132 that is fixed to and extends forwardly from the front slide panel 112. A motor 134 (powered via a power cord (not shown)) is mounted to the bracket 132. An axle 136 attached to the motor 134 extends between the motor 134 and the motor mounting arm 131. A sprocket 138 is mounted on the axle 136 near the motor mounting arm 131. The axle 136 and the sprocket 138 are rotatable relative to the mounting arm 131 and the mounting bracket 132 about a transverse horizontal axis A1.

Referring now to FIGS. 6 and 7, the vial pick-up unit 140 includes the chain 142 and a plurality of pick-up fingers 144 (seven fingers 144 are illustrated in FIG. 6, but any number of fingers may be employed, including only one). The chain 142, which comprises a series of links interconnected with pivoting pins, is endless and is positioned within the channel 109*c* and the channels in the chain track 109, then extends downwardly from the forward end of the channel adjacent the slot 109*f* to engage the sprocket 138 and rearwardly therefrom into the forward end of the channel 109*c*. Thus, the chain 142 travels on a chain path CP outside of the cavity 103 defined by the channels and the sprocket 138 (see FIGS. 6 and 7).

Each of the fingers 144 (one of which is shown in FIG. 7) has a base 145 that is fixed to the chain 142 via an extended length pivot pin that extends through the chain slots 109*b*, 109*d*, 109*f*. A projection 146 extends away from the base 145 in a direction generally parallel with the portion of the chain 142 to which the finger 144 is attached. The projection 146 is sized and shaped to fit within an object to be picked up; it may be square, rectangular, circular, oval or shaped otherwise in cross-section, and may be tapered at its end to facilitate entry into an open-ended object. An agitation prong 148 (see FIG. 8C) extends inwardly generally perpendicularly to the chain 142. Those skilled in this art will recognize that in some embodiments it may be desirable for the fingers to be configured as hooks or the like to engage the outer diameter of the object to be picked up rather than the inner cavity.

The fingers 144 are free to travel along a pick-up path PP (FIGS. 6 and 8C) that is generally parallel to and inwardly from the chain path CP; more specifically, the pick-up path PP has a generally horizontal and rearward run PP1 that extends from the sprocket 138 to the rear end of the channel 109*c*, an upward run PP2 beside the channel 109*c* and the lower portion of the slot 109*b*, an angled run PP3 beside the slot 109*b* as it extends upwardly and forwardly, and a drop-off loop PP4 as it rises, then falls while extending forwardly beside the slot 109*f*.

Figure 8A:
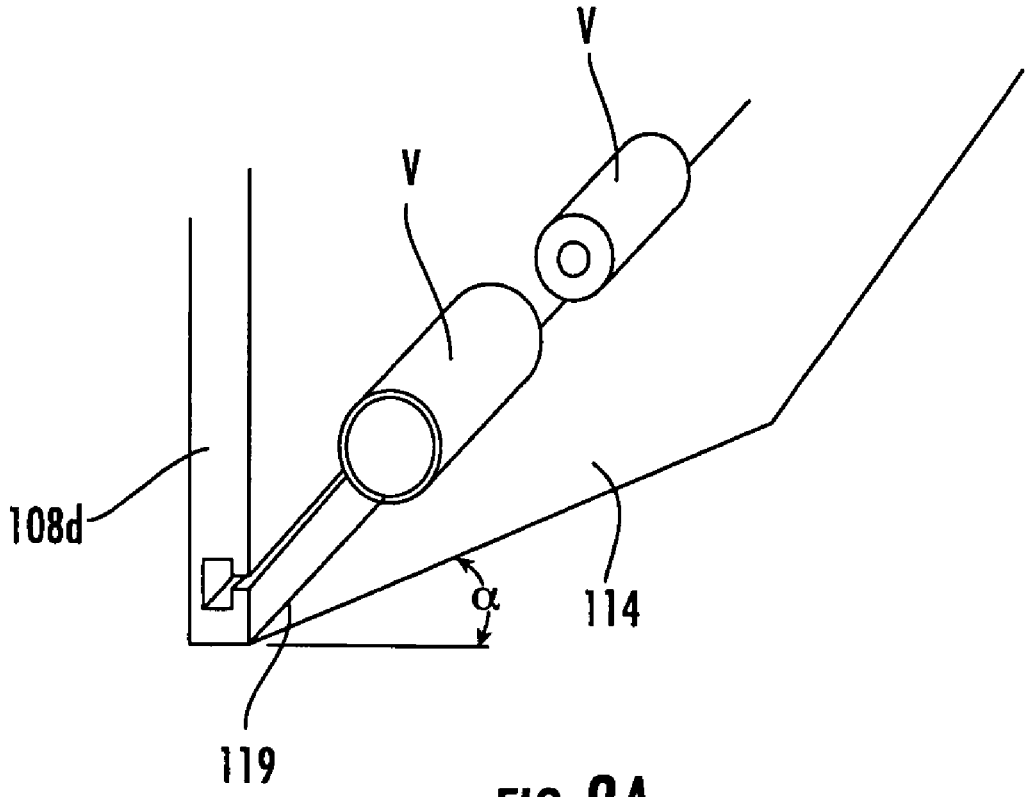
FIGS. 8A-8D are sequential views of the vial dispenser of FIG. 4 showing the motion of an exemplary finger as it captures and dispenses a vial.
Figure 8B:
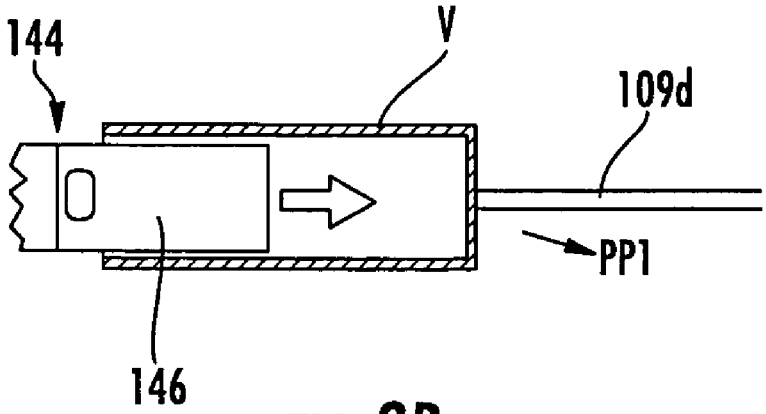
Figure 8C:
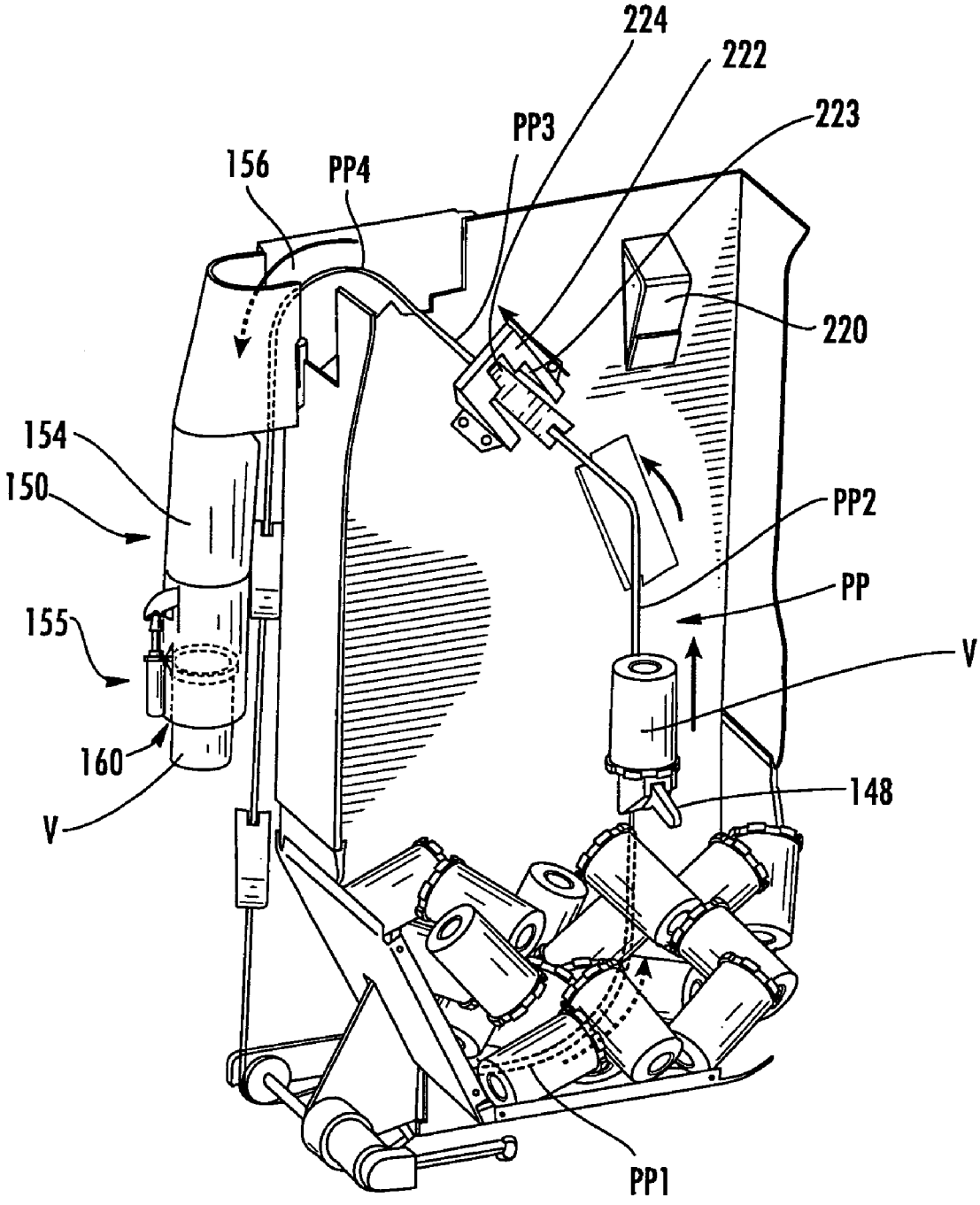

It can also be seen from FIGS. 6 and 8C that an anti-stacking wedge 220 is mounted on the chain mounting wall 108 above the upward run PP2. In addition, an exit gate 222 having an aperture 223 with an upper recess 224 is mounted on the chain mounting wall 108 straddling the angled run PP3.

Figure 8D:
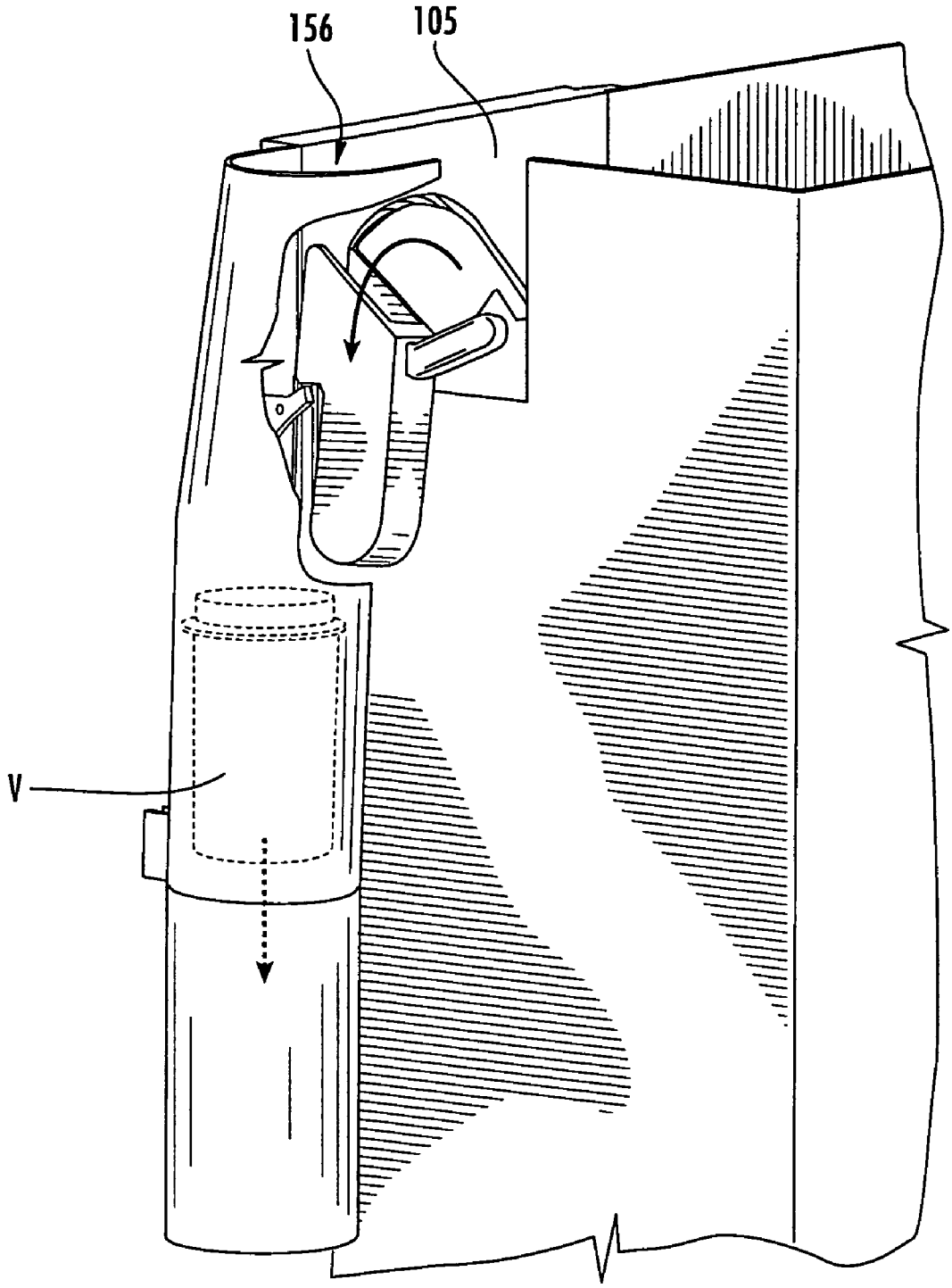

Referring now to FIGS. 8C and 8D, the delivery chute 150 is attached to the housing 102 such that the upper end of a tube 154 thereof is positioned forwardly of the finger exit opening 105. The tube 154 includes a cutaway portion 156 that is fed by the finger exit opening 105. The lower end of the tube 154 terminates in an outlet 160 that feeds into a labeler or other vial receiving unit.

Figure 9A:
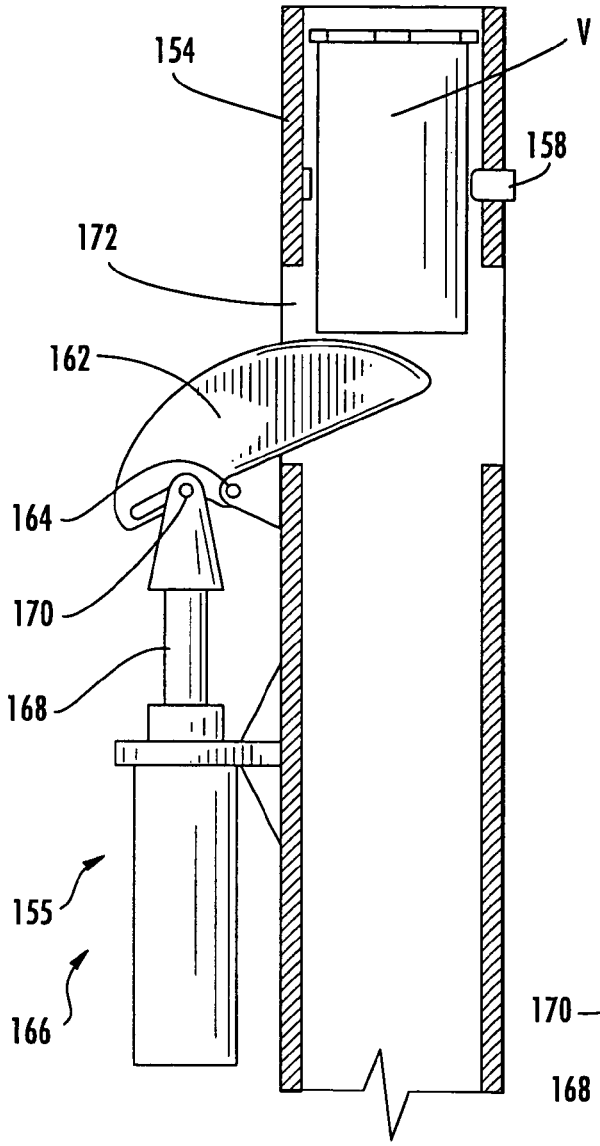
FIGS. 9A and 9B are sequential views of the capture mechanism of the vial dispenser of FIG. 4 showing the arrival and dispensing of a vial.
Figure 9B:
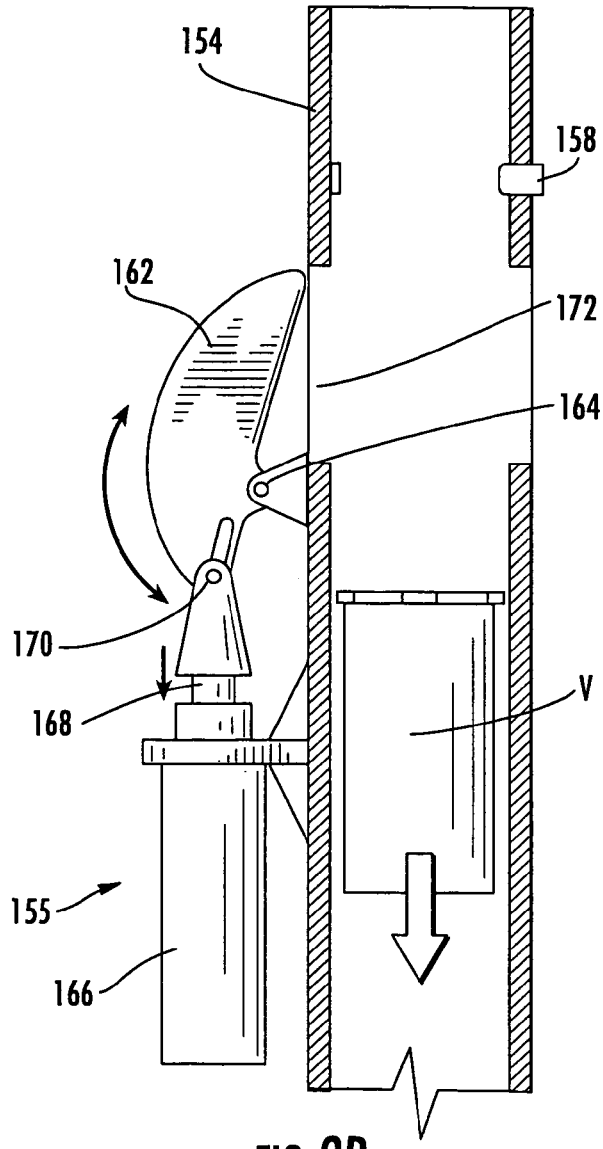

Referring to FIGS. 9A and 9B, the capture mechanism 155 is mounted to the delivery chute 150. The capture mechanism 155 includes a capture member 162 that is pivotally interconnected with the forward surface of the tube 154 at a pivot 164. In the illustrated embodiment, the engagement member has an arcuate upper edge. A solenoid 166 with an extendable rod 168 is mounted to the front surface of the tube 154 below the capture member 162, with the upper end of the rod 168 pivotally interconnected to the lower end of the capture member 162 at a pivot 170. The rod 168 is biased toward the extended position by a spring or other biasing component. In the position shown in FIG. 9A, the rod 168 is extended from the solenoid 166, such that the capture member 162 extends into the tube 154 through a slot 172.

In operation, vials are initially loaded into the cavity 103 of the housing 102 via the door 106*a*. When a prescription is received, and the operator enters the prescription information, the controller 42 signals the container dispensing station 100 that a vial is needed. This signal activates the drive unit 130 such that the motor 134 rotates the axle 136 and attached sprocket 138 about the axis A1. This rotation drives the chain 142 around the chain path CP; the chain 142 travels in a counterclockwise direction from the vantage point of FIG. 8C. As the chain 142 moves, the fingers 144 attached thereto also move along the pick-up path PP in a counterclockwise direction. As the fingers 144 travel along the pick-up path, the projections 146 are generally parallel with the pick-up path and point "ahead" or "downstream" in the pick-up path PP, i e., in the direction of travel.

It should also be noted that, as the fingers 144 travel within the cavity 103 along the pick-up path, the agitation prongs 148 attached to some of the fingers 144 extend into the cavity 103 and stir or agitate the vials contained therein. Movement of the vials tends to encourage the vials to orient in the following manner. As vials V within the housing 102 gradually descend after loading and/or agitation, they are funneled by gravity to the seam 119 (see FIG. 8A) between the floor 114 and the bottom panel 108*d* of the chain mounting wall 108 (the seam 119 being generally parallel with the floor 114). In addition, the sloped disposition of the floor 114 urges the vials V to orient themselves parallel with the seam 119 (see FIG. 8A). As such, the vials V become oriented such that an axis that is generally perpendicular to the open end of the vial V is generally parallel to, and in some embodiments coincident with, the pick-up path of the fingers 144, and are positioned at the lower end of the floor 114 as they reside adjacent the seam 119.

As shown in FIG. 8B, as the fingers 144 travel along the rearward run PP1 of the pick-up path PP and enter the finger entry window 115, the projections 146 extend toward the rear wall 110. Entry of the fingers 144 into the finger entry window 115 may be facilitated by the presence of the deflectors 114*a*, 114*b*. As a finger 144 approaches an oriented vial V along the rearward run PP1 as the vial V resides adjacent the seam 119, if the open end of the oriented vial V faces forwardly, the projection 146 of the finger 144 can enter the open end of the vial V and capture the vial V thereon. If instead the open end of the oriented vial V faces rearwardly, the projection 146 simply pushes the vial V away from the pick-up path PP and proceeds along the pick-up path PP. The finger 144 can then either pick up another vial V as it proceeds along the rearward run PP1 of the pick-up path PP, or will simply not pick up a vial V on that pass.

After a finger 144 has captured a vial V, it proceeds on the pick-up path PP through the upward and angled runs PP2, PP3. In the event that a number of vials V have become nested or interlocked end-to-end (including in some instances one vial V of a stack or nest of vials being captured on the finger 144), the stacked vials V are likely to contact the anti-stacking wedge 220 and become dislodged from each other, thereby preventing the deposition of extra vials in the delivery chute 150 and/or the clogging of the housing 102. Also, as the finger 144 travels on the angled run PP3, it passes through the aperture 223 of the exit gate 222 (if an agitation prong 148 is present, it passes through the recess 224). The aperture 223 is sized such that a vial V of the proper size can pass therethrough, but a vial of an improper larger size cannot. If an oversized vial is inadvertently present in the housing 102 and picked up by the finger 144, the vial will be unable to pass through the aperture 223, with the result that the chain 142 will stop moving (and, in some embodiments, activate an audible alarm) or the oversized vial will be deflected by the exit gate 222 and return to the housing 102; in either event, the oversized vial is prevented from reaching the delivery chute 150.

In addition, the motor 134 may be configured such that it can drive the chain 142 in the opposite direction (clockwise from the vantage point of FIG. 8C). This reversal of direction of the fingers 144 can serve to dislodge vials that might become lodged at different locations within the housing 102 and cause the container dispensing station 100 to jam, and/or can be employed to agitate the vials in the housing 102.

The finger 144 then proceeds from the angled run PP3 to the drop-off loop PP4 (see FIG. 8C). As the projection 146 of the finger 144 reaches the descending portion of the drop off loop PP4 and begins to point downwardly, the vial V can slip off of the projection 146 and travel through the finger exit window 105 and the cutaway portion 156 of the tube 154 into the delivery chute 150 (see FIG. 8D). In some embodiments, the drop-off loop PP4 is configured so that the vial V remains on the projection 146 for a sufficient time to drop consistently into the delivery chute 150.

In some embodiments of the dispensing apparatus, a vial V dropped into the delivery chute 150 will simply drop to a waiting carrier for subsequent processing. However, in some embodiments, including the illustrated embodiment, it may be desirable to "pre-stage" vials in the dispensing chute 150 in order to coordinate dispensing of vials with other operations of the system 40. As one example of a pre-staging operation, the capture mechanism 155 can release a previously captured vial V from the delivery chute 150 for use in filling a prescription, then capture a next vial V after it has been picked up by the pick-up unit 140 and deposited in the delivery chute 150.

The operation of the capture mechanism 155 can be understood with reference to FIGS. 9A and 9B. The capture mechanism 155 begins in the "capture" position shown in FIG. 9A, with the rod 168 extended and the engagement member 162 pivoted about the pivot 164 such that that the capture member 162 extends through the slot 172 into the delivery chute 150. A vial V delivered by the pick-up unit 140 drops "open end up" until the lower end of the vial V strikes the engagement member 162. The presence of the vial V is detected by a sensor 158 located adjacent and just above the capture member 162 (although any number of locations for the sensor may be employed), which signals the controller 42 that a vial is present and in position for subsequent dispensing. The vial V remains in this position until the controller 42 signals the capture mechanism 155 to release the vial in the manner described below. When a vial V is present, the controller 42 signals the container dispensing station 100 to deactivate the motor 134 in order to cease operation.

Upon the receipt of a signal from the controller 42 that a vial V is needed from the delivery chute 150, a power source activates the solenoid 166 of the capture mechanism 155. Activation of the solenoid 166 retracts the rod 168 into the solenoid 166 (thereby overcoming the resistance provided by the spring). This action draws the pivot 170 downwardly, which in turn rotates the capture member 162 about the pivot 164. This action draws the capture member 162 to a "passage position" out of the delivery chute 150 through the slot 172 (FIG. 9B), thereby enabling the vial V to drop through the lower portion of the dispensing chute 150 and out of the outlet 160. Notably, the arcuate upper edge of the capture member 162 provides a support surface for the vial V that is relatively constant in elevation, which can assist in maintaining the vial V in its upright orientation. The controller 42 then deactivates the solenoid 166, which causes the rod 168 to extend and, in turn, the capture member 162 to extend into the delivery chute 150 to receive the next vial V. The controller 42 also signals the motor 134 to activate in order to provide another vial V to the capture mechanism 155.

Those skilled in this art will appreciate that it may be desirable to configure the container dispensing station 100 to dispense different sizes of vials. One technique for handling different vials is to provide for the floor 114 to be adjustable in height, either through the use of inserts or the capability of raising and/or lowering the floor 114 itself. Changing the elevation of the floor 114 in turn changes the height of the axis of vials resting in position to receive a finger 144. Thus, a smaller vial can be properly positioned on the pick-up path PP by raising the floor 114, and a larger vial can be properly positioned on the pick-up path PP by lowering the floor 114. Also, for some sizes of vials it may be desirable to replace the fingers 144 with fingers of a different size that can fit within the selected vial. Alternatively, the floor 114 may be disposed at a steeper angle relative to the side wall 108 in order to raise the height at which the axis of the vials resides.

Figure 10A:
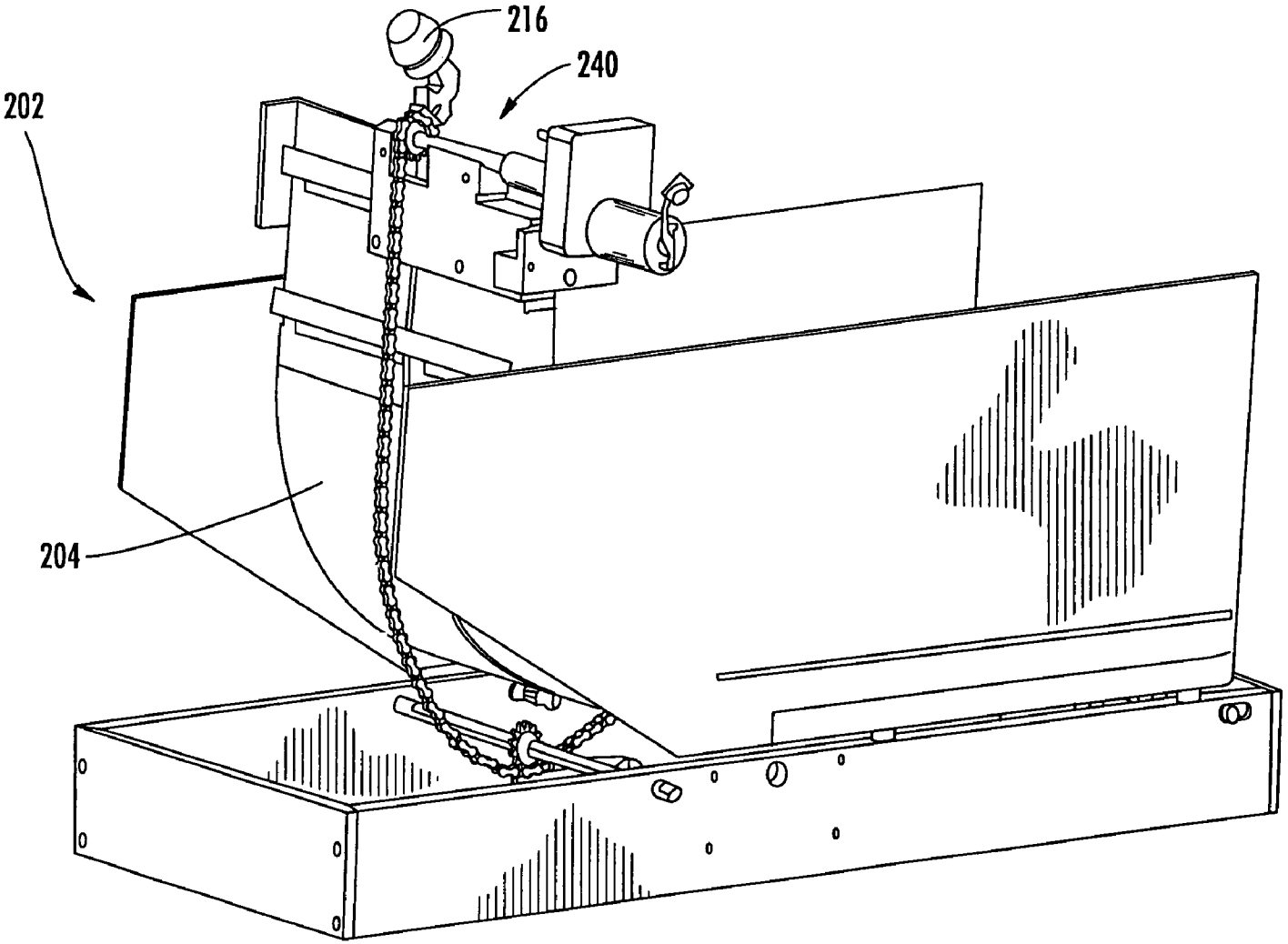
FIGS. 10A and 10B are, respectively, front perspective and rear perspective views of a vial dispenser in accordance with alternative embodiments of the present invention.
Figure 10B:
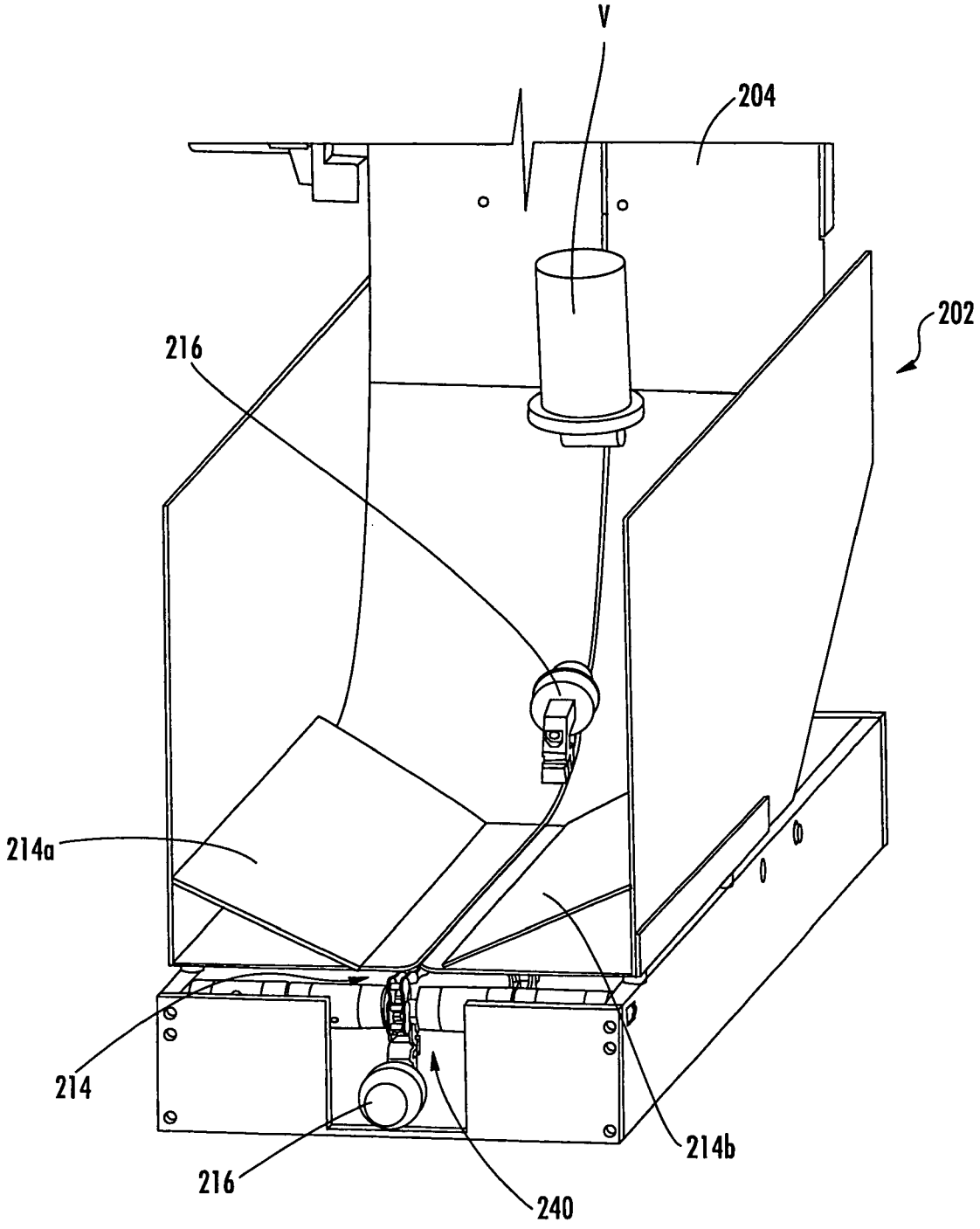

Those skilled in this art will also appreciate that the container dispensing station 100 may take any number of different configurations. As one example, the walls and floor of the housing may be curved or segmented rather than planar. As another example, the chain 142 may be replaced with a belt or other flexible endless member, and may be mounted on the outside of the chain mounting wall 108 or inside the cavity 103 rather than inside the chain track 109, and may include other type of guides to define its travel path. As a further example, and as illustrated in FIGS. 10A and 10B, a housing 202 may have a floor 214 with two sections 214*a*, 214*b* that slope toward each other, such that the vials are picked up from a location away from a side wall. In such an embodiment, the pick-up unit 240 may be mounted below the floor 214 and to the front wall 204, with vials V being conveyed forwardly along the floor 214 and upwardly along the front wall 204 by fingers 216 before being deposited in a dispensing chute (not shown) mounted forwardly of the front wall 204.

As further alternatives, the chain mounting wall 108 may include on its inner surface guides, such as fins, fingers and the like, adjacent the pick-up path PP that can guide vials that are not completely seated on a finger 144. The pick-up path PP may vary; for example, the angled portion PP3 of the pick-up path PP may be omitted. There may be multiple pick-up paths. Rather than including pick-up fingers 144, the pick-up unit may include other pick-up members that capture the outside, rather than the inside, of a vial; for example, the pick-up member may be a complete or partial hoop, cup, hook or the like. The agitation prong 148 may be omitted and some other agitation means (such as a separate agitation device, a shaking or vibratory mechanism, a rotating knobbed disk, or an incoming airstream) may be used to agitate the vials, or agitation may be omitted entirely. The capture mechanism 155 may be omitted in some embodiments, may take a different configuration, or may even be manually actuated. Other variations will be apparent to the ordinarily skilled artisan and need not be set forth in detail herein.

As an additional example of an alternative embodiment, the floor may be a generally horizontal conveyor belt that travels in a direction generally perpendicular to the pick-up path. Like the angled floor 114, such a conveyor belt would urge vials in the housing toward the pick-up path.

Those skilled in this art will also understand that the capture mechanism 155 may take different configurations. For example, the linear solenoid 166 may be replaced with a rotary solenoid. Also, although the capture member 162 is illustrated and described as having an arcuate upper surface and as rotating upwardly to retract from the tube 154, the capture member may be of any configuration, and may rotate downwardly or horizontally to retract from the tube 154. Further, the sensor 158 may be located at any number of positions. For example, it may be located below the capture member 162, such that it detects the passage of a vial and signals the controller 42 to move the capture member 162 to the capture position; alternatively, a sensor may be located on a device, such as a vial labeler or the carrier member 70, that receives the vial from the container dispensing station 100 as part of a subsequent operation.

Figure 11A:
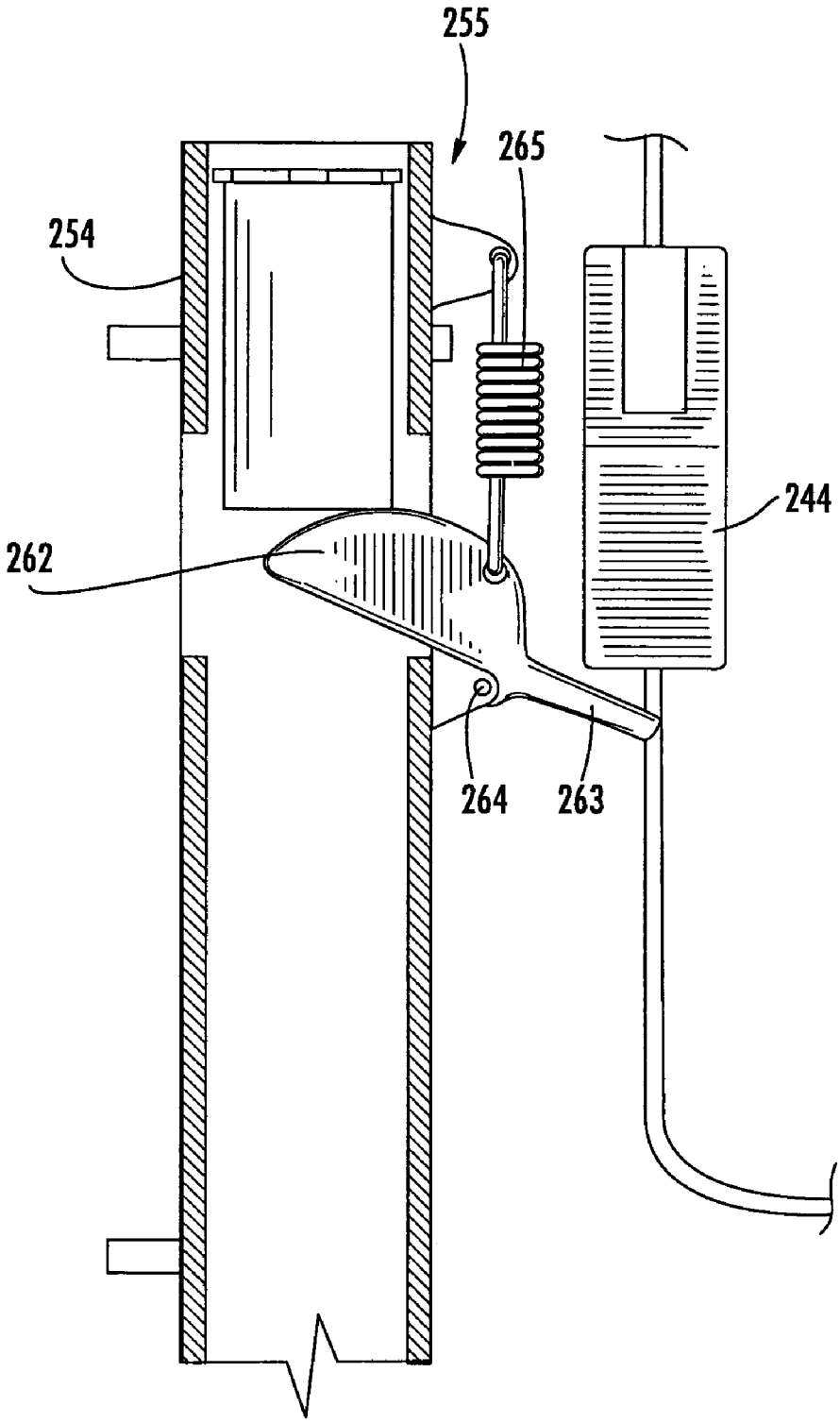
FIGS. 11A and 11B are sequential side views of a capture mechanism according to alternative embodiments of the present invention.
Figure 11B:
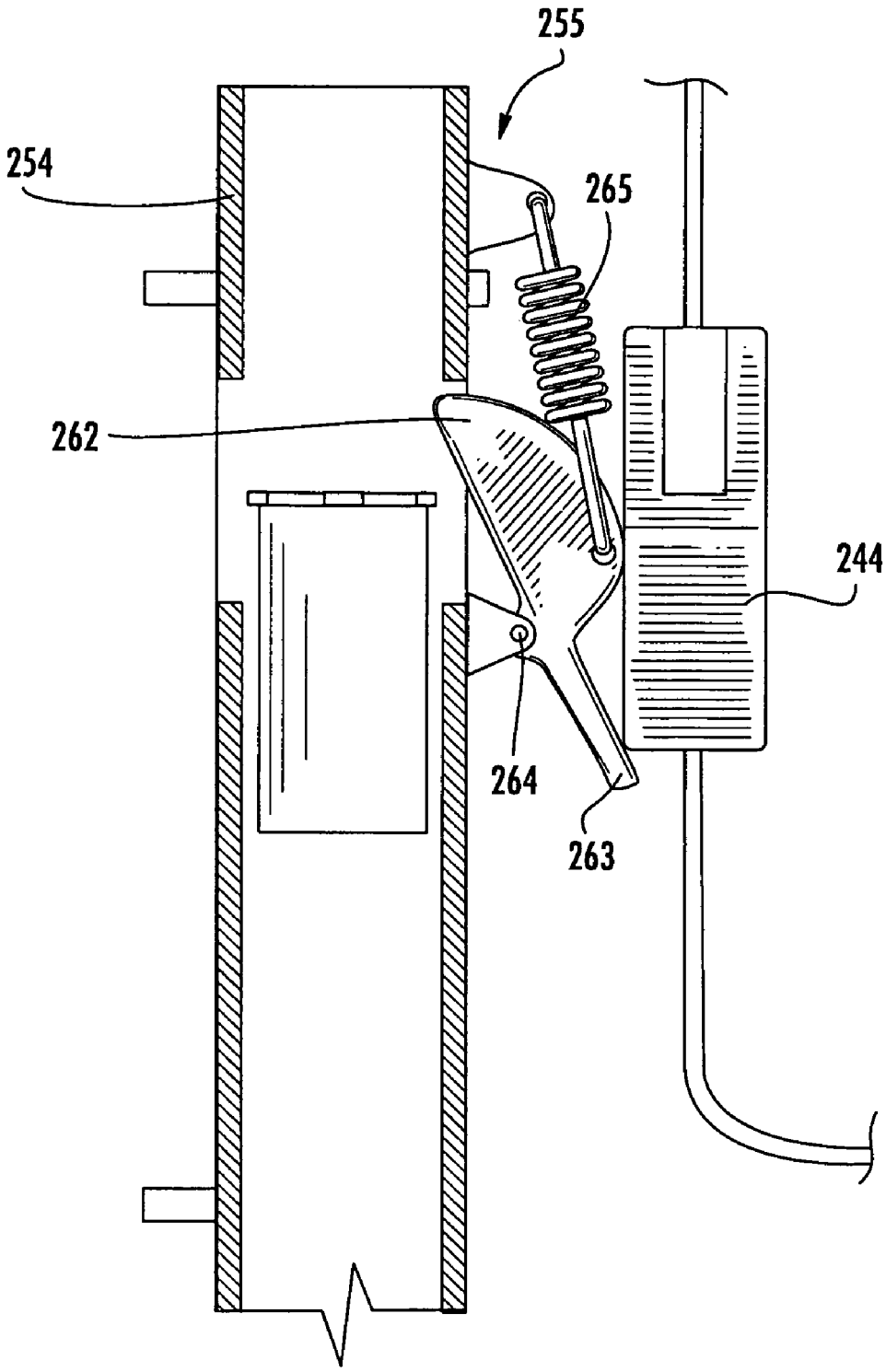

Also, the capture mechanism 155 may be actuated by other actions within the dispensing station 100. For example, the capture mechanism 155 may be actuated via a timer. Alternatively, the capture mechanism may be configured to rely on the movement of a finger 144 past a specified location to release a captured vial. Such a configuration is shown in FIGS. 11A and 11B, which illustrate a capture mechanism 255. The capture mechanism 255 includes a capture member 262 that is mounted to the dispensing chute 254 at a pivot 264. The capture member 262 includes a tail 263 that extends into the travel path of the fingers 244. The capture member 262 is biased via a spring 265 toward the capture position (shown in FIG. 11A). As the fingers 244 pass the capture member 262, the fingers 244 engage the tail 263 and force the capture member 262 to the retracted position (FIG. 11B). Other configurations will be recognizable to those skilled in this art.

The capture mechanism 155 is described herein as receiving and dispensing only a single vial at a time; however, in some embodiments it may be desirable for the capture mechanism to receive, store or dispense more than one vial at a time.

It should be noted that the container dispensing station 100 can also be employed to dispense open-ended objects other than pharmaceutical vials, such as pipes, tubes, casings, springs, and the like; the dispensing station can dispense objects that are closed at one end, such as pharmaceutical vials, or open at both ends, such as a tube or pipe. It should also be noted that the container dispensing station 100 may also be utilized as a "stand-alone" station for dispensing vials without being integrated into a system such as the system 40 described herein.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for dispensing singulated open-ended objects, the apparatus comprising:

a housing having a guide and an internal cavity configured to house open-ended objects, the housing including a dispensing exit;

a pick-up unit mounted to the housing, the pick-up unit including an endless member and at least one pick-up member attached to the endless member;

a drive unit;

wherein the endless member engages the drive unit and the guide for movement relative thereto;

wherein the at least one pick-up member is mounted to the endless member such that, as the drive unit drives the endless member, the at least one pick-up member travels on a pick-up path, at least a portion of which is within the housing and includes a generally horizontal run and an upward run that merges with the generally horizontal run;

a delivery chute attached to the housing such that an upper end thereof is fed by the dispensing exit, wherein the delivery chute comprises a tube;

a capture mechanism associated with the delivery chute, the capture mechanism movable between a capture position, in which an object cannot pass through the tube of the delivery chute, and a passage position, in which an object can pass through the tube of the delivery chute; and a controller operably associated with the drive unit and the capture mechanism, the controller being configured to detect when a captured object has passed through the delivery chute and move the capture mechanism back to the capture position responsive thereto.

2. The apparatus defined in claim 1, wherein the controller is configured to activate the drive unit when the capture mechanism moves to the passage position to permit a captured object to pass through the delivery chute.

3. The apparatus defined in claim 1, wherein the controller is configured to detect when an object delivered by the delivery unit has been captured by the capture mechanism and to deactivate the drive unit responsive thereto.

4. The apparatus defined in claim 1, wherein the capture mechanism includes a capture member that extends into the delivery chute when the capture mechanism is in the capture position, and wherein the capture member has an arcuate upper edge.

5. The apparatus defined in claim 1, wherein the housing contains a plurality of pharmaceutical vials.

6. An apparatus for dispensing singulated open-ended objects, the apparatus comprising:

a housing having a guide and an internal cavity configured to house open-ended objects, the housing including a dispensing exit;

a pick-up unit mounted to the housing, the pick-up unit including an endless member and at least one pick-up member attached to the endless member;

a drive unit;

wherein the endless member engages the drive unit and the guide for movement relative thereto;

wherein the at least one pick-up member is mounted to the endless member such that, as the drive unit drives the endless member, the at least one pick-up member travels on a pick-up path, at least a portion of which is within the housing;

a delivery chute attached to the housing such that an upper end thereof is fed by the dispensing exit, wherein the delivery chute comprises a tube having a wall;

a capture mechanism associated with the delivery chute, the capture mechanism movable between a capture position, in which an object cannot pass through the delivery chute, and a passage position, in which an object can pass through the delivery chute, wherein the capture mechanism includes a capture member that extends through an opening in the wall of the tube and into the tube of the delivery chute when the capture mechanism is in the capture position; and a controller operably associated with the drive unit and the capture mechanism, the controller being configured to detect when a captured object has passed through the delivery chute and move the capture mechanism back to the capture position responsive thereto, the controller further configured to detect when an object delivered by the delivery unit has been captured by the capture mechanism and to deactivate the drive unit responsive thereto.

7. The apparatus defined in claim 6, wherein the portion of the pick-up path that is within the housing includes a generally horizontal run and an upward run that merges with the horizontal run.

8. An apparatus for dispensing singulated open-ended objects, the apparatus comprising:

a housing having a guide and an internal cavity configured to house open-ended objects, the housing including a dispensing exit;

a pick-up unit mounted to the housing, the pick-up unit including an endless member and at least one pick-up member attached to the endless member;

a drive unit;

wherein the endless member engages the drive unit and the guide for movement relative thereto;

wherein the at least one pick-up member is mounted to the endless member such that, as the drive unit drives the endless member, the at least one pick-up member travels on a pick-up path, at least a portion of which is within the housing;

a delivery chute attached to the housing such that an upper end thereof is fed by the dispensing exit, wherein the delivery chute comprises a tube having a wall;

a capture mechanism associated with the delivery chute, the capture mechanism movable between a capture position, in which an object cannot pass through the delivery chute, and a passage position, in which an object can pass through the delivery chute, wherein the capture mechanism includes a capture member that extends through an opening in the wall of the tube and into the tube of the delivery chute when the capture mechanism is in the capture position; and a controller operably associated with the drive unit and the capture mechanism, the controller being configured to detect when a captured object has passed through the delivery chute and move the capture mechanism back to the capture position responsive thereto.

9. The apparatus defined in claim 8, wherein the portion of the pick-up path that is within the housing includes a generally horizontal run and an upward run that merges with the horizontal run.

* * * * *